United States Patent [19]

Kayner

[11] Patent Number: 4,796,847

[45] Date of Patent: Jan. 10, 1989

[54] DESKTOP ORGANIZER

[76] Inventor: Morris Kayner, 8800 Boulevard East, North Bergen, N.J. 07047

[21] Appl. No.: 103,427

[22] Filed: Sep. 30, 1987

[51] Int. Cl.[4] ..... A47B 19/00

[52] U.S. Cl. ..... 248/441.1; 248/452

[58] Field of Search ..... 248/441.1, 451, 452, 248/453, 459, 174; 108/32; 281/45, 20, 42

[56] References Cited

U.S. PATENT DOCUMENTS

| | | | |
|---|---|---|---|
| 744,888 | 11/1903 | Widman | 108/32 |
| 1,818,253 | 8/1931 | Hermann | 248/441.1 |
| 3,121,407 | 2/1964 | Wise | 108/32 |
| 3,541,701 | 11/1970 | Barnes | 281/45 X |
| 3,756,550 | 9/1973 | Kollitz | 248/206.5 |
| 3,794,284 | 2/1974 | Guenther | 248/441.1 |
| 4,162,055 | 7/1979 | Summers | 248/441.1 |

FOREIGN PATENT DOCUMENTS

| | | | |
|---|---|---|---|
| 1313665 | 11/1962 | France | 248/441.1 |

*Primary Examiner*—J. Franklin Foss

*Attorney, Agent, or Firm*—Cohen, Pontani & Lieberman

[57] ABSTRACT

A desktop organizer includes a pair of article support surfaces positionally-juxtaposed at different fixed angles for concurrently retaining a plurality of articles for concurrent reference by the user. The organizer may be formed at least in part of a ferromagnetic material and used in conjunction with desktop accessories carrying magnetic strips for magnetic cooperative releasable attraction to the organizer for enhancing the retention of articles to the article support members.

11 Claims, 2 Drawing Sheets

DESKTOP ORGANIZER

FIELD OF THE INVENTION

The present invention relates to accessories for use in conjunction with a conventional desk or work surface and, in particular, to apparatus for selectively and concurrently supporting a plurality of articles on a desktop in positions facilitating the concurrent availability and use of the articles.

BACKGROUND OF THE INVENTION

The desks both of busy executives and of office workers are often innundated with large numbers of the books, reports and loose papers which constitute a mix of completed tasks, work in progress and a variety of materials regularly or somewhat less often referred to in the normal business day. The efficiency of those working with or having to concurrently make reference to a multiplicity of articles—such as notes, letters, reports and books and the like—on a desktop or other tabletop surface is often significantly reduced by the difficulty necessarily inherent in repeatedly locating, picking up, repositioning and returning these materials to various locations and orientations on the desktop. The added presence of increasing numbers of such accessories as staplers, adhesive tape and paper clip dispensers, pen and pencil holders, telephone directories, fileboxes, memo pads and ashtrays on the desktop—each of them typically a separate item—further clutters the work area and interferes with the worker's efficient use of normal reference materials. Indeed, even with a relatively uncluttered desktop the need to repeatedly refer to several papers or documents or books in a substantially concurrent manner virtually requires continual reorientation of those articles so that the worker often finds himself "wishing" for more than two hands.

OBJECTS OF THE INVENTION

It is accordingly the desideratum of the invention to provide apparatus for facilitating user reference to a plurality of articles on a desktop without requiring unnecessarily repeated reorientations of the articles. It is a particular object of the invention to provide such an apparatus wherein a plurality of articles are concurrently and selectively supportable thereon for ready and facilitated viewing by the user.

It is another object of the invention to provide such an apparatus which is portable and is therefore readily relocatable about, onto or off of a desktop at the convenience and desire of the user.

It is a further object of the invention to provide such an apparatus wherein plural articles are supportable in a spaced relation to each other which facilitates substantially concurrent reference to the articles.

It is another object of the invention to provide such an apparatus which is additionally capable of retaining desktop accessories stored thereon.

It is a still further object of the invention to provide such an apparatus which may be used in conjunction with auxiliary article retaining devices releasably securable to the apparatus.

Yet another object of the invention is to provide such an apparatus that is relatively low in cost and which may be readily and economically manufactured utilizing widely available materials and well known techniques.

Further objects, features and advantages of the present invention will be more fully appreciated by reference to the following detailed description of a presently preferred, but nonetheless illustrative, embodiment in accordance with the invention when taken in conjunction with the accompanying drawing.

BRIEF DESCRIPTION OF THE DRAWING

In the drawing, wherein similar reference characters denote similar elements throughout the several views.

DETAILED DESCRIPTION OF THE PREFERRED EMBODIMENT

Figure 1:
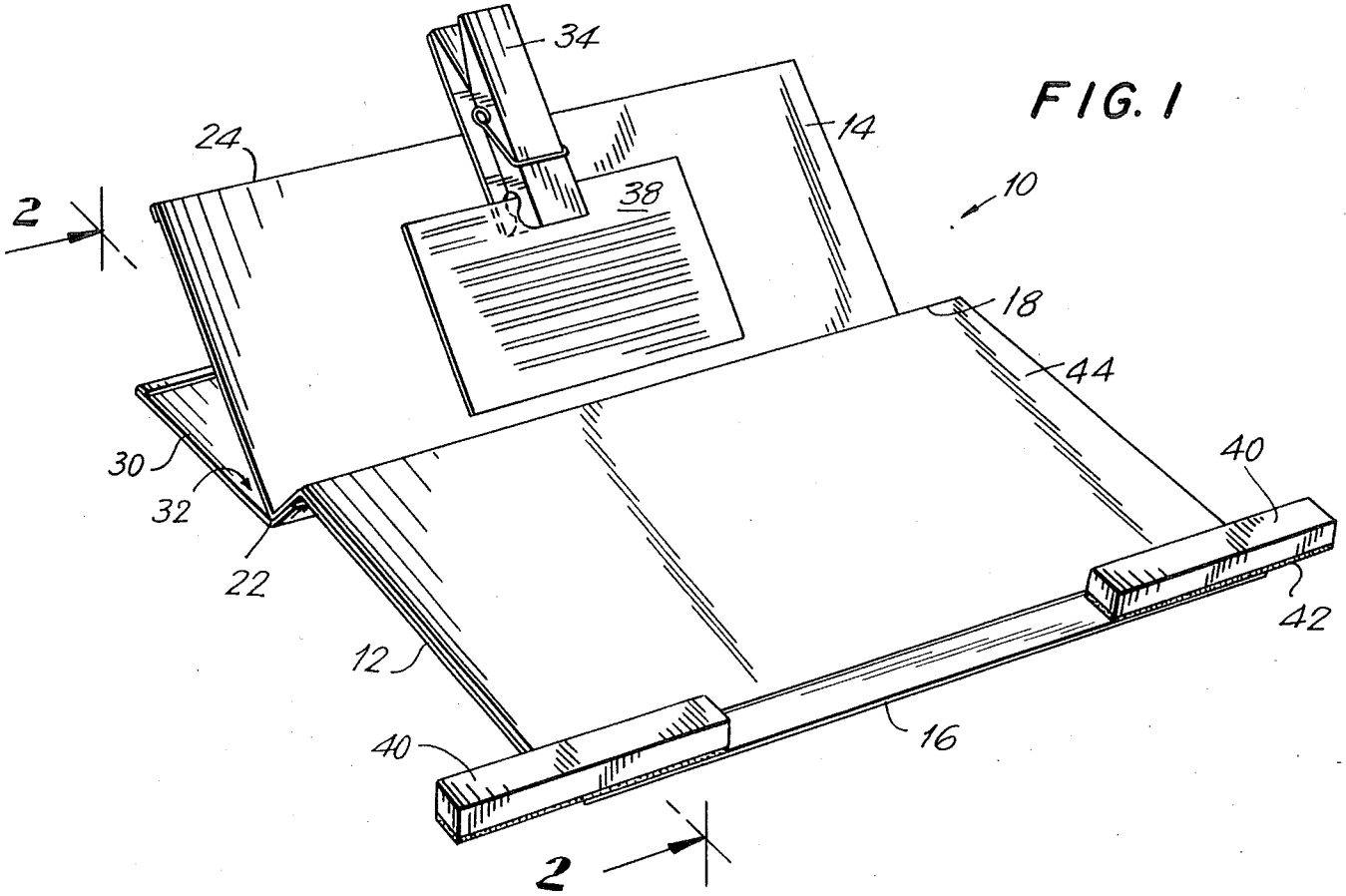
FIG. 1 is an elevated perspective view of a desktop organizer constructed in accordance with the present invention.
Figure 2:
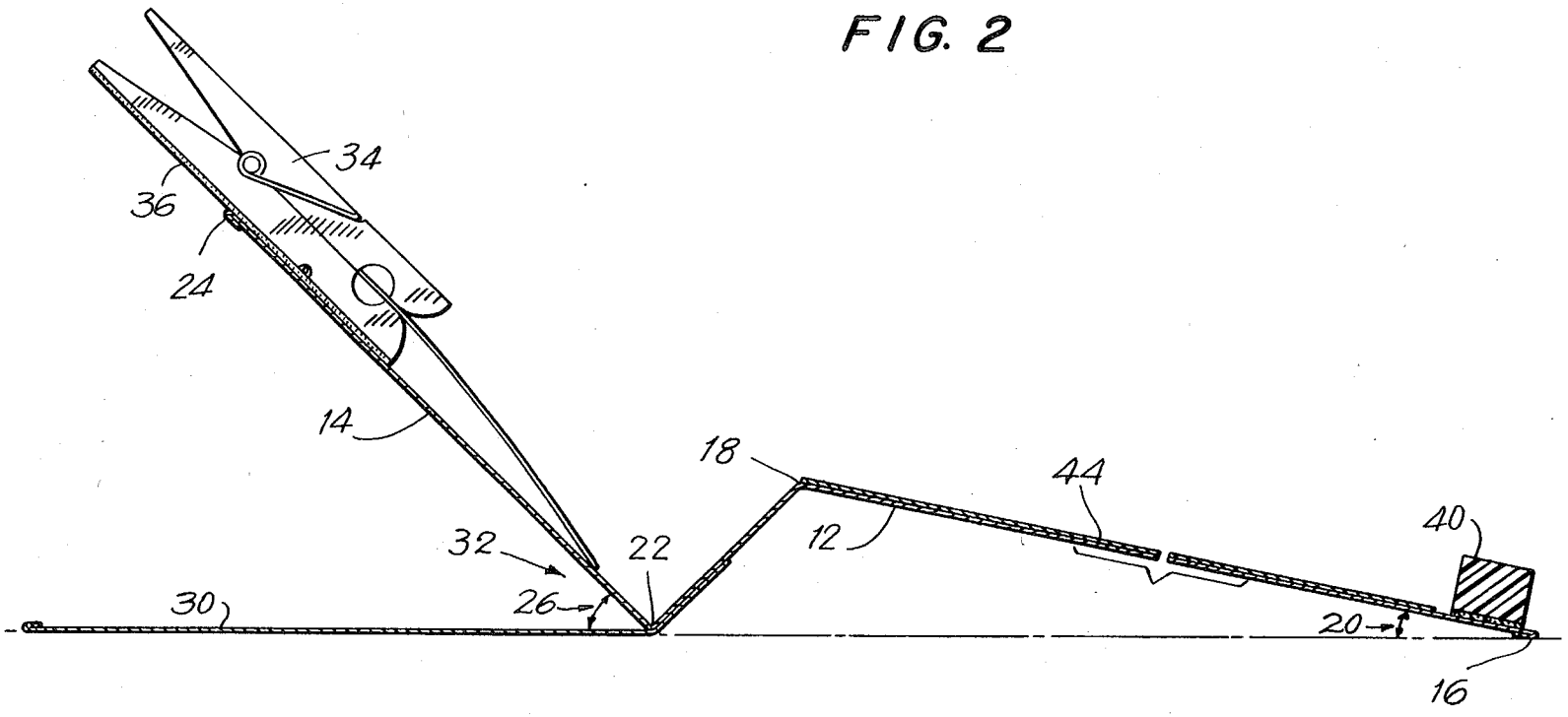
FIG. 2 is an end view of the desktop organizer taken along the lines 2—2 in FIG. 1.

The present invention is directed to a desktop organizer for concurrently and selectively supporting a plurality of articles in positions facilitating the ready availability and use of the articles by a worker. At the outset, it should be understood that although the term "articles", as used in this disclosure, broadly encompasses books and papers or documents, it is not intended to be specifically so limited and may thus include any and all materials which a worker may use, or view, or refer to and which are fully or partially supportable by the organizer of the invention. Similarly, in the preferred embodiment herein disclosed and described in detail, the organizer of the invention is portable and is operatively positionable in self-supported freestanding relation on a desktop. It may, on the other hand, be permanently affixed to a desktop at a location appropriate to the worker's needs and preferences. The organizer is also preferably unitarily constructed at least in part of a suitably metallic or otherwise ferromagnetic material to enable magnet-carrying accessories to be magnetically cooperatively retained on the organizer. All of the foregoing aside, it should nevertheless be appreciated that the embodiment of the invention herein disclosed although currently preferred, is but one of many possible forms of a desktop organizer embodying the invention and is intended merely as a vehicle by which the present invention is herein taught.

Turning now to the drawing, a desktop organizer identified by the general reference numeral 10 is unitarily constructed of a relatively rigid material for self-supported, freestanding operative positioning on a desktop, tabletop or work surface. Although any suitable material of construction may be employed, as will become clear as this description proceeds, it is preferred that the material comprising at least portions of the organizer be ferromagnetic such, for example, as steel or other metals exhibiting that property. Indeed, for convenience and ease of manufacture the entire organizer 10 may be unitarily manufactured of the same ferromagnetic material.

Organizer 10 includes first and second members 12, 14 which define first and second article support surfaces, respectively. Each of the members 12, 14 is formed as a substantially flat plane and, with the organizer operatively positioned on a desktop, each member is disposed at a predetermined incline or angle relative to the generally flat desktop on which the organizer rests.

More particularly, the first member 12 extends from a front edge 1 which operatively abuts and is directly supported on the desktop to a rear edge 18 which is vertically upwardly spaced from the desktop. Thus first member 12 presents an upward slope as one moves from its front edge 16 to its rear edge 18. The angle 20 of that slope or incline, relative to the desktop, is preferably in the range of approximately 5° to 25° and, most preferably, the angle is approximately 10° to provide a relatively gentle incline with respect to the supporting desktop Similarly, second member 14 extends from a front edge 22 operatively disposed in supported abutment with the desktop to a rear edge 24 which is vertically upwardly spaced from the desktop. Thus, second member 14 also upwardly slopes or rises moving from its front edge 22 to its rear edge 24, defining an angle 26 with the desktop. The angle 26 of second member 14 is preferably in the range of approximately 40° to 70°, and is most preferably approximately 50°, relative to the desktop. It will accordingly be recognized that second member 14 presents an article support surface providing a steeper slope than the relatively gentle incline of first member 12 and, in its preferred form a significantly steeper slope. It will, as this description proceeds, become apparent that the relative slopes of the first and second members 12, 14 and their relative proximal placement with respect to each other advantageously facilitate the concurrent use of multiple articles supported on the desktop organizer 10 by a user thereof.

The first and second members or article support surfaces 12, 14 are unitarily connected by a bridge member 28. Bridge member 28 is formed, in the embodiment of the invention herein disclosed, as a substantially flat plane which extends between the upwardly raised rear edge 18 of first member 12 and the desktop abuting front edge 22 of second member 14, and serves several important functions. First, the rearwardly sloping member 28 fixes the separation or spacing between the first and second article support surfaces 12, 14 so that a user may easily and conveniently view and otherwise have immediate and concurrent access to articles supported on both those surfaces. And bridge member 28, being relatively rigid in construction, assists in enabling the desktop organizer 10 to operatively lie on the desktop in self-supporting, freestanding relation. Finally, in conjunction with second member 14 the bridge member 28 defines an article capturing trough or well or channel between the first and second members 12, 14 for receiving a portion of an article resting on surface 14 and/or for capturing and retaining miscellaneous articles placed on the organizer.

A substantially flat planar base member o plate 30 extends unitarily rearwardly from the conjunction of second member front edge 22 and bridge member 28. Base member 30 extends along and rests supportedly on the desktop to provide enhanced self-supporting rigidity to the organizer 10 and, in particular, to second member 14. In addition, base member 30 defines in conjunction with second member 14 an article storage area 32 within which articles or materials are retainable and relocatable together with the entire organizer 10 when the same is moved about, onto or away from the desktop.

It is preferred that at least portions of at least the first and second members 12, 14 be constructed of or incorporate ferromagnetic material so that magnets and objects to which magnets or magnetic strips are secured are magnetically cooperably retainable to those portions of the desktop organizer. It is most preferred that the entirety of at least the first an second members be so formed of ferromagnetic material. In any event, the present invention further contemplates the inclusion of auxiliary article retaining accessories for facilitating the support and retention of articles on organizer 10.

As for example illustrated in the drawing, a spring-loaded clamp 34 of known form is provided along at least a portion of one of its surfaces with a strip 36 of magnetic material. This arrangement enables magnetically cooperable and releasable retention of clip 34 to any ferromagnetic portion of second member 14 with the spring-loaded clamp being capable of holding a sheet of paper 38 or other article between its spring-urged jaws for ready viewing and access by a user of the desktop organizer of the invention.

In similar fashion, each of a pair of generally rectangular blocks 40 carry a magnetic strip 42 on one surface thereof for attraction to and cooperative releasable retention on a ferromagnetic portion of first member 12, as for example at or proximate its front edge 16. Blocks 40 function in the nature of positionally-adjustable and removable ledges for retaining pens or pencils or other articles that might otherwise roll or be carried down inclined first member 12 and away from organizer 10 under the natural force of gravity.

First member 18 may also be provided with a full or partial covering 44 along its article retaining surface to protect articles supported on first member 12, to facilitate writing or drawing on articles supported on the surface, to enhance the appearance of organizer 10, or for any other appropriate purpose. Covering 44 may be implemented using any convenient material, including for example blotter paper, and may permit or prevent the transmission of sufficient magnetic permeability therethrough to enable the retention of magnetic materials directly to the covered ferromagnetic portion of first member 12.

Those skilled in the art will further recognize an appreciate that strips of magnetic material or the like may similarly be affixed to a wide range of objects, including desk accessories such as staplers, adhesive tape dispensers and the like, for releasable magnetic retention to the desktop organizer 10. In this manner such desk accessories and other objects may be retained on o to the organizer in positions and orientations facilitating their ready availability to the user.

In use, the desktop organizer 10 of the invention is selectively positioned at a suitable location on the desktop or other work surface. Desktop-supporting abutment of the front edge 16 of first member 12, the front edge 22 of second member 14, and the rearward extension of base number 30 with the desktop fully sustains the organizer in self-supported freestanding relation thereon. The unitary construction of the organizer and the substantial rigidity of its members assures adequate support for a wide range of articles and reference materials used and required by the worker.

Each of the first and second members 12, 14 are disposed at different fixed inclinations relative to the desktop for concurrently supporting a plurality of positionally-juxtaposed articles. Thus, while the proximal first member slopes upwardly at a relatively gentle angle from the user for supporting one or more articles such as papers or books, the distal and rearwardly-juxtaposed second member 14 tilts upward at a relatively steep or sharp inclination providing ready reference and accessibility to similar articles supported thereon. The trough or channel defined between the front edge 22 of second member 14 and bridge member 28 facilitates the retention of articles in supported relation on the sharply-inclined second member by capturing the lower-disposed portions of such articles as they rest against member 14. The trough also operatively serves as a convenient well for writing implements and the like both during use and non-use or storage of the organizer 10. The article storage area 32 defined between second member 14 and base member 30 similarly provides a convenient area in which articles or reference materials not currently required, but which may be readily substituted for those then supported on surfaces 12 or 14, may be placed. Writing implements and other accessories may also be stored in this area at the option of the user.

Where at least predetermined portions of the desktop organizer are formed of a ferromagnetic material, retention of articles to the organizer support surfaces 12, 14 may be further enhanced, and an even wider range of articles may be accommodated through the use of accessories—such for example the spring-loaded clamp 34 and the ledge-defining blocks 40. Through magnetic cooperative releasable attraction between the magnets or magnetic strips carried on such accessories the same are effective to facilitate use of the organizer 10 with an unusually wide range of articles and for varied applications limited only by the imagination of the user. Affixation of similar magnetic strips to conventional desktop accessories such as staplers and the like, in conjunction with the desktop organizer 10 of the invention, further facilitate the attainment of a compact and unusually organized work area on an otherwise crowded or cluttered desktop.

A desktop organizer in accordance with the invention may generally be dimensioned as a matter of design choice. In the currently preferred embodiment illustrated in the drawing, by way of example, the first number 12 may have a front-to-back depth of approximately 12 inches, the second number 14 a front-to-back depth of approximately 8 inches, the bridge member 28 a front-to-back depth of approximately 3 inches, and the base member 30 a front-to-back depth of approximately 8 inches, all of these members having a transverse width of approximately 17 inches. The transverse widths of the various individual members of the organizer may alternatively be different with respect to each other, again as a matter of design choice.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as limited by the scope of the claims appended hereto.

What is claimed is:

1. A unitary desktop organizer operatively positionable in self-supported freestanding relation on a desktop for selectively and concurrently supporting a plurality of articles in positions facilitating the availability and use of the articles, comprising:

a first substantially planar member operatively disposed at a first angle relative to the desktop and extending from a front edge for supported abutment with the desktop to a rear edge vertically upwardly spaced from the desktop to define a first article support surface;

a second substantially planar member operatively disposed at a second angle relative to the desktop and extending from a front edge for supported abutment with the desktop to a rear edge vertically upwardly spaced from the desktop to define a second article support surface, said second angle being greater than said first angle;

a third substantially flat planar member unitarily connecting said first member rear edge and said second member front edge and defining an article capturing trough between said first and said second members; and a substantially planar base member unitarily connected to said second member front edge and extending rearwardly therefrom along and supportedly on the desktop to define a third article support surface, said base member and second member defining therebetween an article storage area; and wherein said first and second members are constructed at least in part of ferromagnetic material so as to provide at least portions of said first and second article support surface to which articles having magnetic means are magnetically cooperably retainable; and further comprising article retaining means including a surface having a magnetic portion for magnetically cooperable and releasable retention of said article retaining means to at least one of said first and second members for facilitating support of articles of said organizer.

2. A desktop organizer in accordance with claim 1, wherein each of said first, second, third and base members are constructed of a substantially rigid material so that said unitary desktop organizer is operatively supported on a desktop solely by the combination of said first member front edge, said second member front edge and said base member.

3. A desktop organizer in accordance with claim 1, wherein said second member rear edge is upwardly spaced from the desktop by an amount greater than the upward spacing of said first member rear edge from the desktop.

4. A desktop organizer in accordance with claim 1, wherein each of said first, second and base members are constructed of a substantially rigid material so that said desktop organizer is operatively supported on a desktop solely by the combination of said first member front edge, said second member front edge and said base member.

5. A desktop organizer in accordance with claim 1, wherein said first angle is in the range of approximately 5° to 25° and said second angle is in the range of approximately 40° to 70°.

6. A desktop organizer in accordance with claim 1, wherein said first angle is approximately 10° and said second angle is approximately 50°.

7. A desktop organizer in accordance with claim 1, wherein each of said first and second members comprises a substantially flat plane.

8. A desktop organizer in accordance with claim 1, wherein each of said first, second and third members comprises a substantially flat plane.

9. A desktop organizer in accordance with claim 1, further comprising ledge means carried on said first member proximate said front edge thereof and projecting from said first member in a direction remote from the desktop to define a stop for facilitating the retention of an article on said first member.

10. A desktop organizer in accordance with claim 9, wherein said ledge means is removably carried on said first member.

11. A desktop organizer in accordance with claim 10, wherein at least a portion of said first member proximate its front edge is formed of a ferromagnetic material and said ledge means has at least a portion which has magnetic properties such that said ledge means is magnetically cooperably retainable on said first member portion proximate its front edge.

* * * * *